United States Patent [19]

Connell et al.

[11] Patent Number: 5,064,060

[45] Date of Patent: Nov. 12, 1991

[54] KIT FOR HOLDING CAPS ONTO CONTAINERS

[76] Inventors: John J. Connell, R.R. #1, Box 2319, Hyde Park, Vt. 05655; Whitaker Hartt, R.R. #3, Box 2350, Morrisville, Vt. 05661

[21] Appl. No.: 572,390

[22] Filed: Aug. 27, 1990

[51] Int. Cl.[5] ..... B65D 73/00; B65D 85/00

[52] U.S. Cl. ..... 206/227; 206/231; 206/338; 206/447; 206/460

[58] Field of Search ..... 206/227, 231, 223, 338, 206/447, 460, 495, 497, 461, 467

[56] References Cited

U.S. PATENT DOCUMENTS

| | | | |
|---|---|---|---|
| 2,142,194 | 1/1939 | Karfiol | 206/447 |
| 2,170,147 | 8/1939 | Lane | 206/447 |
| 3,414,093 | 12/1968 | Chostner | 206/460 X |
| 3,730,739 | 5/1973 | Seiferth et al. | 206/461 X |
| 4,143,767 | 3/1979 | MacDonald | 206/223 X |

*Primary Examiner*—Paul T. Sewell
*Assistant Examiner*—Jacob K. Ackun, Jr.
*Attorney, Agent, or Firm*—Terry M. Gernstein

[57] ABSTRACT

A kit contains a plurality of mounting strips that are releasably attached to a backing element and which can be permanently fixed to a container of a container/cap combination, and a plurality of cap attaching elements which are releasably attached to the backing element and which can be permanently fixed to a cap of the container/cap combination. The mounting strips and the cap attaching elements all have releasably fastening elements, such as hook-and-loop fasteners, which cooperate to releasably attach a cap mounted cap attaching element to a container mounted mounting strip when the cap is removed from a container covering position whereby the cap will be kept in a convenient location during use of the container.

7 Claims, 4 Drawing Sheets

FIG. 4
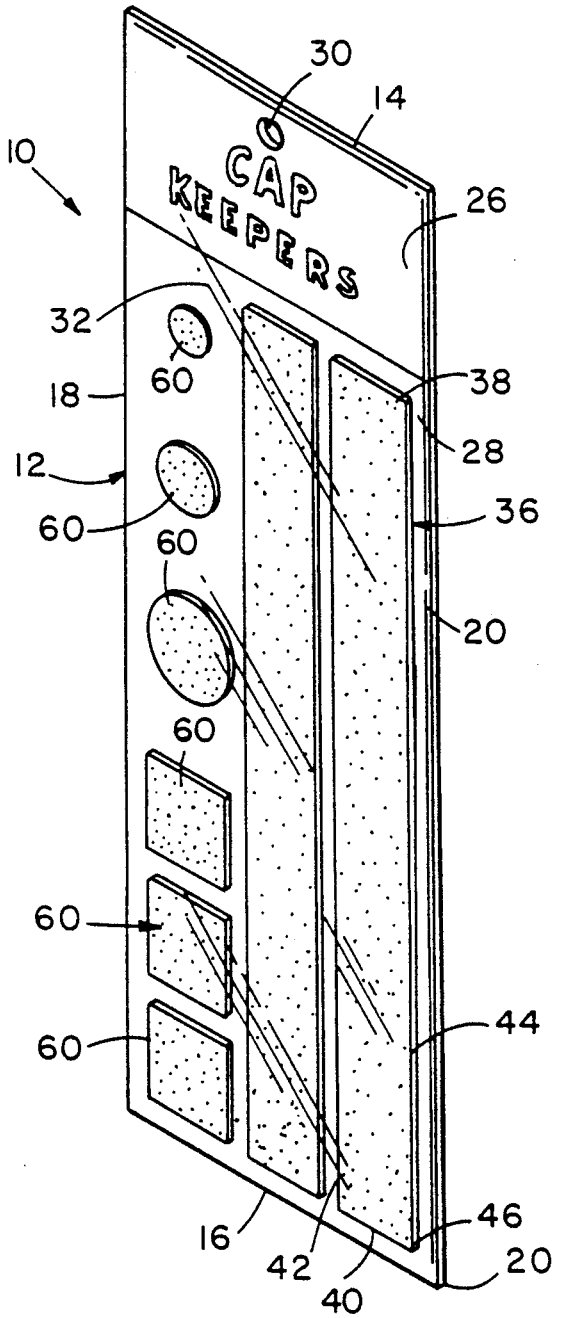
FIG. 5
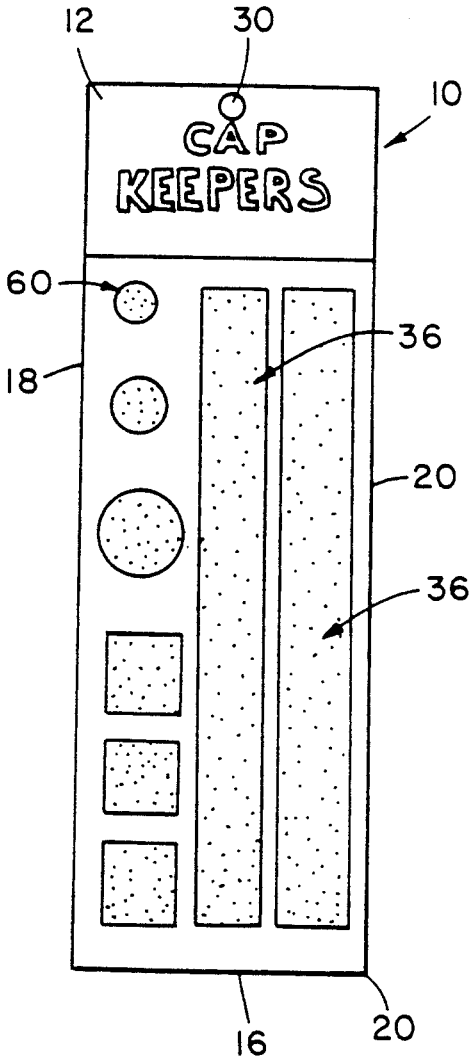
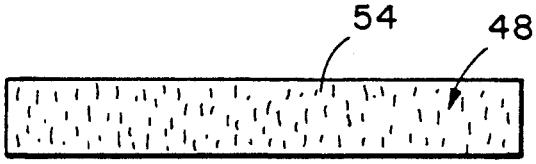
FIG. 6
FIG. 7
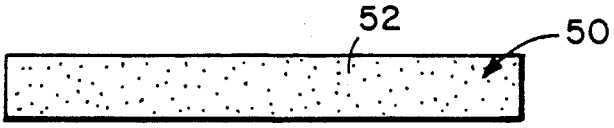

KIT FOR HOLDING CAPS ONTO CONTAINERS

TECHNICAL FIELD OF THE INVENTION

The present invention relates to the general art of containers, and to the particular field of caps for containers and, specifically, to means for preventing loss of such caps.

BACKGROUND OF THE INVENTION

Many products, such as glue, toothpaste, shaving lotion, condiments, and the like, are packaged in dispensing containers, such as squeeze containers or the like. As indicated in FIGS. 1–3, such containers generally include a body B in which the material M is stored, a cap C which is releasably mounted on the container body by various means, such as a threaded connection T, a snap fit S or a friction fit F, or the like.

The inventor has observed that while such containers are quite convenient, they have several drawbacks. For example, the cap C must be removed in order to dispense the product M from the container. This cap often becomes lost or misplaced while the container is in use, or if the user forgets to replace the cap after use. If the container is not properly re-sealed, the product can dry out or degrade during storage.

While the art contains disclosures of caps which are tethered to a container body, such tethers often are cumbersome or inconvenient to use, and may interfere with the use of the product in some circumstances. Still further, tethering may make the container or the cap more expensive to manufacture than a non-tethered container/cap combination.

Still further, many product containers are of the refillable type and the tethering may wear out. Many users have such containers and such containers are quite useful, except for the cap being loose. Such containers should not be discarded merely for the reason that they do not have a cap or have a cap that can become lost.

Therefore, there is a need for a means to maintain a container cap together with a container, and which can be used in conjunction with containers which have no means for attaching a cap to the container body, and which can be retrofit onto existing containers.

OBJECTS OF THE INVENTION

It is a main object of the present invention is to provide a means to maintain a container cap together with a container.

It is another object of the present invention to a means to maintain a container cap together with a container, and which can be used in conjunction with containers which have no means for attaching a cap to the container body.

It is another object of the present invention to a means to maintain a container cap together with a container, and which can be used in conjunction with containers which have no means for attaching a cap to the container body, and which can be retrofit onto existing containers.

SUMMARY OF THE INVENTION

These, and other, objects are achieved by a kit which includes a plurality of different strips which can be fixed to various container bodies and a plurality of different cap attaching elements which can be fixed to various container caps. The mounting strips and the cap attaching elements have contact adhesive on one side to permanently affix the item to the associated container element and releasable fastening means on another side thereof. The releasable fastening means on the cap-mounted cap attaching element cooperates with the releasable fastening means on the container body mounted mounting strip to releasably attach a cap to the container body while the container is in use. The cap is thus maintained in a convenient location.

The releasable fastening means can include hook-and-loop fastening means, or the like, and the kit items can be used in conjunction with any container/cap combination. Therefore, existing combinations can be retrofit or if it is less expensive to manufacture a container/cap combination as separate items and provide the kit separately, a manufacturer has this option. Alternatively, the kit can be sold in stores.

The kit contains different size and shaped elements so different size and style container/cap combinations can be accommodated. The kit is packaged whereby it can be sold as a separate item in stores or through the mail or the like.

BRIEF DESCRIPTION OF THE DRAWING FIGURES

FIG. 4 is a front and side perspective view of a kit embodying the present invention.

FIG. 5 is a front elevational view of the kit.

FIG. 6 is a top plan view of a mounting strip which is fixed to a container body, showing the releasable fastening means on such mounting strip.

FIG. 7 is a rear view of the mounting strip showing the adhesive means on that mounting strip.

DETAILED DESCRIPTION OF THE PREFERRED EMBODIMENT OF THE INVENTION

Figure 1:
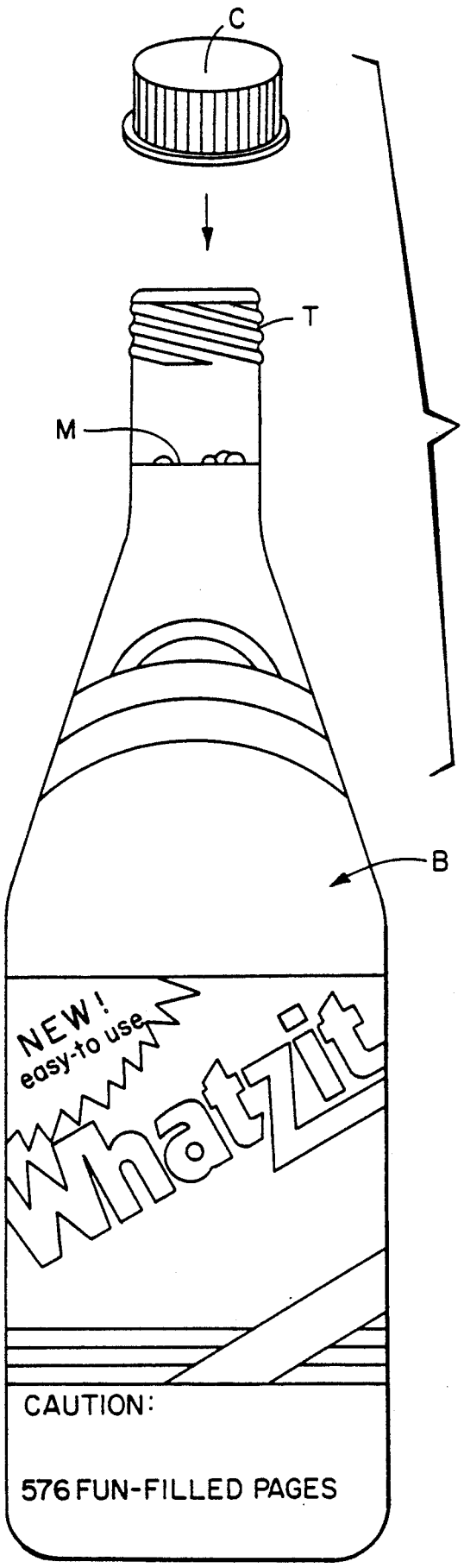
FIG. 1 (PRIOR ART)
FIG. 1 is an exploded front elevational view of a prior art cap/container combination in which the cap is not tethered to the container body.
Figure 2:
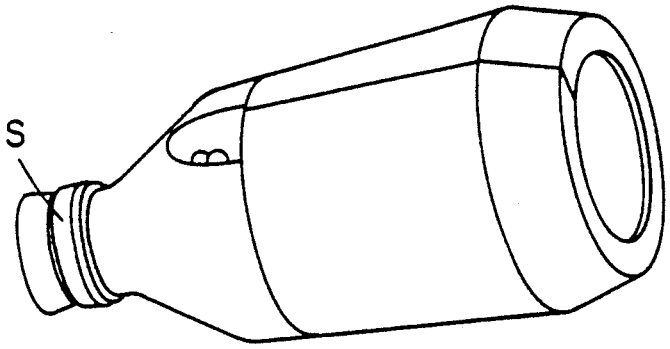
FIG. 2 (PRIOR ART)
FIG. 2 is a rear perspective view of a prior art cap/-container combination in which the cap is not tethered to the container body.
Figure 3:
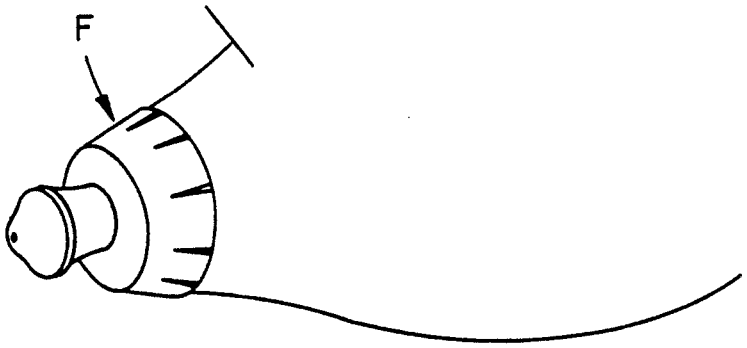
FIG. 3 (PRIOR ART)
FIG. 3 is a partial front perspective view of a prior art cap/container combination in which the cap is not tethered to the container body.
Figure 8:
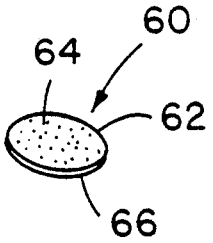
FIG. 8 is a top perspective view of a cap attaching element of the present invention showing the releasable fastening means thereon.
Figure 9:
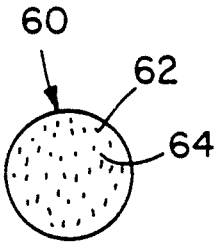
FIG. 9 is a top plan view of the cap attaching element.
Figure 10:
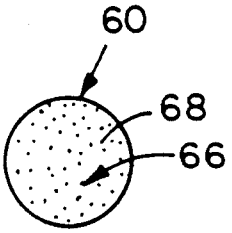
FIG. 10 is a rear view of the cap attaching element showing the adhesive means thereon.

Shown in FIGS. 3 and 4 is a kit 10 which is used to adapt a container/cap combination so that the cap thereof can be stored on the container thereof in a convenient location that is not likely to become lost or misplaced during use of the container.

The kit 10 includes a monolithic, one-piece backing element 12 that is rectangular in peripheral shape and includes two ends 14 and 16 and two sides 18 and 20 connected to the ends at corners, such as corner 22. The backing element 12 includes a rear surface 24 and a front surface 26 which is covered with a waxy substance 28. A hook receiving opening 30 is defined through the backing element so the kit can be displayed in a store, and a transparent covering 32 is heat shrunk over the backing element to enclose the kit and its associated elements as will be understood from the discussion presented hereinbelow. The monolithic one-piece nature of the backing element facilitates the manufacturing thereof as well as the durability thereof.

The kit 10 includes a plurality of monolithic, one-piece rectangular mounting strips 36. These strips are best shown in FIGS. 4–7, and attention is directed to these figures. The strips include ends 38 and 40 and sides 42 and 44 which intersect each other at corners, such as corner 46, and have a length dimension measured between the ends 38 and 40 that substantially exceeds a width dimension measured between the sides 42 and 44. For example, the length dimension is nine times the width dimension in the preferred form of the invention. The strips also include a front surface 48 and a rear surface 50, with contact adhesive 52 being located on the rear surface and a releasable fastening means, such as a hook-and-loop fastening means 54, on the front surface.

The contact adhesive is of the type which will releasably adhere to the waxy surface 28 of the backing element to permit the strip to be temporarily held in place on the backing element, and which will then permanently adhere to a container body to permanently fix the strip to that container body with the releasable fastening means facing outwardly of the container.

The kit 10 also contains a plurality of cap attaching elements 60, best shown in FIGS. 4, 5 and 8–10. The elements 60 are of various sizes and shapes so various size and shape of cap can be accommodated with the same kit. The circular and rectangular shapes shown in the figures are thus merely examples of the shapes that can be used, and are not intended as a limitation.

The element 60 includes a front surface 62 on which releasable fastener means 64, such as hook-and-loop fastener means, or the like, is located, and a rear surface 66 on which adhesive means 68, such as contact glue, or the like, is located. The contact adhesive on the elements 60 is similar to the contact adhesive discussed above in reference to mounting strips 36 whereby the elements 60 can be releasably mounted on the waxy surface so the elements can be stored on the backing element and then which will permanently fix the elements to a cap of a container/cap combination.

Figure 11:
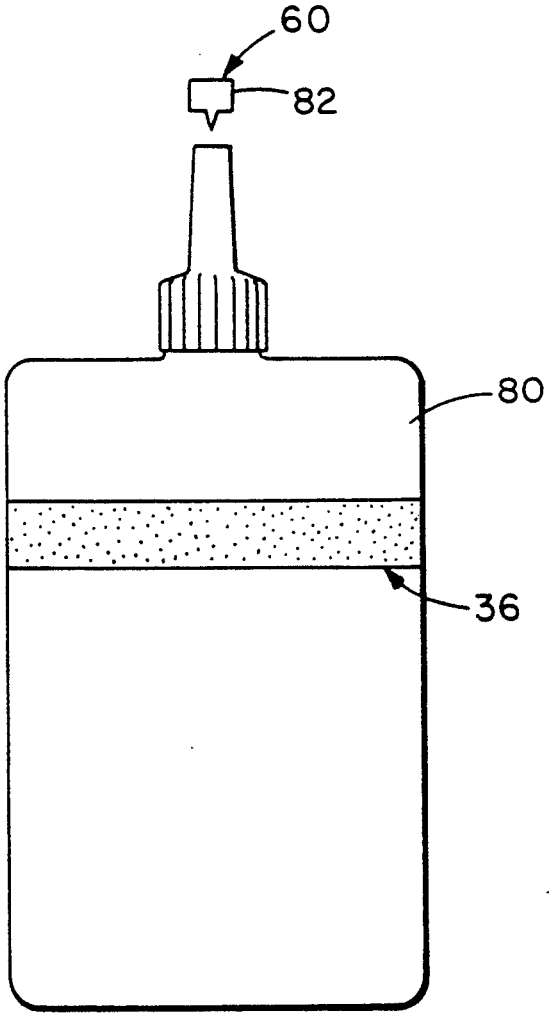
FIG. 11 is a front elevational view of a container/cap combination having a cap attaching element fixed to the cap and a mounting strip fixed to the container body.

As shown in FIG. 11, a mounting strip 36 is removed from the backing element, and, using the adhesive 50, is permanently fixed to the body of a container 80 in a convenient location on that container with the hook-and-loop fastening material facing outwardly of the container.

One of the elements 60 is removed from the backing element, and permanently fixed to a cap 82 using the adhesive 68 with the hook-and-loop fastening material 62 facing outwardly of the cap.

The cap 82 is then releasably attached to the mounting strip via the cooperating hook-and-loop fastening means 54 and 64 when the cap has been removed from the container. The cap is thus retained in a convenient location and is not likely to become lost or separated from the container.

It is understood that while certain forms of the present invention have been illustrated and described herein, it is not to be limited to the specific forms or arrangements of parts described and shown.

We claim:

1. A kit for holding caps onto containers comprising:

A) a monolithic, one-piece backing element having a rear surface and a front surface, and waxy material covering said front surface;

B) a plurality of rectangular mounting strips releasably mounted on said backing element, each mounting strip including (a) two ends and two sides which intersect said ends and form corners at such intersections, (b) a length dimension extending between said two ends, (c) a width dimension extending between said two sides, (d) said length dimension being substantially longer than said with dimension, (e) a front surface, (f) a rear surface, (g) a contact adhesive on said mounting strip rear surface, said contact adhesive releasably adhering to said waxy material covered backing element front surface and is adapted to be permanently, adhered to a container of a container/cap combination, (h) a hook-and-loop fastener means on said mounting strip front surface;

C) a plurality of cap attaching elements releasably mounted on said backing element, each cap attaching element including (1) a front surface, (2) a rear surface, (3) a contact adhesive on said rear surface, said contact adhesive releasably adhering to said waxy material covered backing element front surface and is adapted to be permanently adhered to a cap of a container/cap combination, (4) a hook-and-loop fastener means on said cap attaching element front surface; and D) a transparent covering attached to said backing element and covering said backing element front surface and said mounting strips and cap attaching elements releasably mounted on said backing element front surface.

2. The kit defined in claim 1 wherein said cap attaching elements are circular.

3. The kit defined in claim 2 further including a plurality of cap attaching elements which are square.

4. The kit defined in claim 3 wherein said circular cap attaching elements are all of different diameters whereby different size caps can be covered and securely attached to a mounting strip.

5. The kit defined in claim 4 further including a hook-accommodating opening defined through said backing element adjacent to one end of said backing element.

6. The kit defined in claim 5 wherein said transparent cover is attached to said backing element by a heat shrink attachment.

7. The kit defined in claim 6 wherein the length dimension of said mounting strips is approximately nine times larger than the width dimension of said mounting strips.

* * * * *